US005426273A

United States Patent [19]

Shiau

[11] Patent Number: 5,426,273

[45] Date of Patent: Jun. 20, 1995

[54] SWITCHING APPARATUS FOR AN ELECTRICAL APPLIANCE

[76] Inventor: Shoei-Shuh Shiau, No. 18, Alley 33, Lane 730, Chien-Hsing Rd., Taichung City, Taiwan, Prov. of China

[21] Appl. No.: 241,864

[22] Filed: May 11, 1994

[51] Int. Cl.[6] ..... H01H 13/14

[52] U.S. Cl. ..... 200/520; 200/523; 200/576; 200/320.1; 200/302.2; 200/60; 362/205

[58] Field of Search ..... 200/520, 523, 526, 528, 200/302.1, 302.2, 303, 60, 297, 310, 314; 362/205

[56] References Cited

U.S. PATENT DOCUMENTS

| | | | |
|---|---|---|---|
| 3,924,116 | 12/1975 | Brindley . | |
| 3,924,117 | 12/1975 | Brindley . | |
| 4,286,311 | 8/1981 | Maglica . | |
| 4,843,526 | 6/1989 | Price, III . | |
| 4,940,860 | 7/1990 | Shiau . | |
| 4,951,183 | 8/1990 | Wang . | |
| 5,226,722 | 7/1993 | Maglica . | |
| 5,282,116 | 1/1994 | Shiau . | |
| 5,345,370 | 9/1995 | Murray et al. | 200/60 |

*Primary Examiner*—Robert M. Fetsuga
*Assistant Examiner*—David J. Walczak
*Attorney, Agent, or Firm*—Darby & Darby

[57] ABSTRACT

A switching apparatus has a cylindrically shaped hollow insulated body with first and second parts that sealingly engage each other at longitudinal abutting surfaces. The first part has a longitudinal recess. The body is formed with a radial button retaining passage. A conducting unit is disposed in the recess and includes elongated first and second conducting elements with a respective first end portion contacting a corresponding one of two input terminals of a driven element, and a respective second end portion. The second end portion of the first conducting element contacts one of two output terminals of a power source. A third conducting element has a first end portion extending out of the body and contacting the other output terminal of the power source, and a second end portion spaced apart from the second end portion of the second conducting element. A button unit is movably disposed in the button retaining passage. A conducting contact member is mounted on the button unit and is pushed by a compression spring to contact the second end portions of the second and third conducting elements so as to activate the driven element. A retaining unit is employed to break selectively electrical contact among the second and the third conducting elements and the contact member against action of the compression spring.

8 Claims, 5 Drawing Sheets

SWITCHING APPARATUS FOR AN ELECTRICAL APPLIANCE

BACKGROUND OF THIS INVENTION b 1. Field of the Invention

This invention relates to a switching apparatus for an electrical appliance, more particularly to a switching apparatus with improved conducting unit and button assembly for activating the electrical appliance.

2. Description of Related Art

This invention is an improvement of a conventional switching apparatus, as shown in FIG. 3, which is installed in an electrical appliance for interconnecting electrically a power source, such as a dry cell, and a lamp bulb 19. The power source and the lamp bulb 19 are disposed within the electrical appliance.

The electrical appliance has a circumferential shell 18 which defines a cavity 180 for receiving the switching apparatus, the power source, and the lamp bulb 19. The circumferential shell 18 has an opening 181 formed therethrough and communicated with the cavity 180.

The switching apparatus includes a generally cylindrically shaped body 13 (see FIG. 2) disposed in the cavity 180 of the circumferential shell 18 adjacent to the opening 181. The body 13 has an outer peripheral wall surface which is disposed against an inner wall surface of the circumferential shell 18.

Referring to FIG. 1, the switching apparatus further includes a button assembly 14, a lamp socket assembly 15, a sealing member 16, and a coupling ring 17. The body 13 has a first part 130 in the shape of a segmented cylinder and a second part 131 in the shape of a complementary segmented cylinder. The first and second parts 130, 131 have abutting surfaces which have sloping planes (T) that are inclined longitudinally relative to an axis of the body 13. The sloping planes (T) on the first and second parts 130, 131 of the body 13 have a conforming sloping relationship (see FIG. 2) so that the first and second parts 130, 131 of the body 13 sealingly engage each other. The first part 130 has a first end portion provided with a conducting protrusion 133 for contacting one of the output terminals of the power source, a second end portion provided with an axially extending annular flange 132, and a radial button retaining passage 1301 positioned between the first and second end portions and aligned with the opening 181 of the circumferential shell 18 (see FIG. 3). The annular flange 132 of the first part 130 has externally and internally threaded portions 1321, 1322.

The button assembly 14 includes a body 140 which has a threaded protrusion 1403, a slidable button 142 that is mounted on the body 140, and two connecting wires 1401, 1402. The threaded protrusion 1403 can pass through the entire length of the button retaining passage 1301 into the opening 181 of the circumferential shell 18 (see FIG. 3). The button assembly 14 further includes a ring 1411 which is positioned within the button retaining passage 1301 and which has an internally threaded portion 141 that engages the threaded protrusion 1403 so as to position the button assembly 14 on the first part 130 of the insulated body 13. The connecting wire 1402 is connected electrically to the conducting protrusion 133 of the first part 130.

The sealing member 16, as shown in FIG. 3, has an edge portion interposed between the outer wall surface of the first part 130 and the inner wall surface of the circumferential shell 18, and a dome-shaped central portion covering the opening 181 of the circumferential shell 18.

The coupling ring 17 has internally and externally threaded portions 170, 171 which are engaged respectively with the externally threaded portion 1321 of the annular flange 132 of the first part 130 and the inner wall surface of the circumferential shell 18 so as to position the first part 130 on the circumferential shell 18.

Referring again to FIGS. 1 and 3, the lamp socket assembly 15 includes a compression spring 150, an envelope 151, and a lamp socket 152. The lamp socket 152 is provided with a passage which can receive the lamp bulb 19 and the envelope 151 therein, and has a first end section formed with an internally threaded portion 1522 for engaging an externally threaded portion 191 of the lamp bulb 19, and a second end section formed with an externally threaded portion 1521 for engaging the internally threaded portion 1322 of the annular flange 132 of the first part 130 of the insulated body 13. The compression spring 150 is positioned within the envelope 151 and is capable of interconnecting electrically the contact of the lamp bulb 19 and the connecting wire 1401 of the button assembly 14 at two end portions thereof.

Even though the combination of all of the components of the switching apparatus can provide a water resistance effect thereto, it is quite difficult to assemble the different components of the switching apparatus together since most of the components thereof are threaded on their inner or outer surfaces. In addition, a lot difficulty is encountered during the manufacture of these components, thus resulting in a higher manufacturing cost.

SUMMARY OF THE INVENTION

The main objective of this present invention is to provide a switching apparatus installed in an electrical appliance and with improved button assembly and conducting unit so as to allow the switching apparatus to be assembled easily and so as to allow the different components of the switching apparatus to be manufactured easily, thereby decreasing the manufacturing cost of the switching apparatus.

Another objective of this present invention is to provide a switching apparatus which has a waterproof structure that can prevent the intrusion of moisture into the switching apparatus.

According to this invention, a switching apparatus is installed in an electrical appliance and is adapted to interconnect electrically two output terminals of a power source and two input terminals of a driven element for controlling the operation of the driven element. The switching apparatus includes a generally cylindrically shaped hollow insulated body, a conducting unit, a button assembly, and a sealing member.

The insulated body has a first part in the shape of a segmented cylinder and a second part in the shape of a complementary segmented cylinder. The first and second parts have longitudinally extending abutting surfaces. The first part confines a longitudinally extending recess and has first and second end walls disposed respectively on two ends of the recess. The first end wall is formed with two holes adapted to permit passage of the input terminals of the driven element therethrough. The second end wall is formed with a notch. The insulated body is formed with a radial button retaining passage which is positioned between the first and second end walls and which is communicated with the recess. The insulated body further has a radial slot.

The conducting unit is disposed in the recess of the first part of the insulated body and includes elongated first and second conducting elements which have a respective first end portion that is adapted to be connected electrically to a corresponding one of the input terminals of the driven element, and a respective second end portion. The second end portion of one of the first and second conducting elements extends through the notch of the second end wall of the first part of the insulated body and is adapted to be connected to one of the output terminals of the power source. The conducting unit further includes a third conducting element which has a first end portion that extends out of the insulated body via the slot and that is adapted to be connected to the other one of the output terminals of the power source, and a second end portion spaced apart from and adjacent to the second end portion of the other one of the first and second conducting elements.

The button assembly includes a button unit movably disposed in the button retaining passage of the first part, a conducting contact member mounted on one end portion of the button unit and disposed adjacent to the second end portions of the third conducting element and the other one of the first and second conducting elements, a spring means for biasing the button unit in a radial outward direction to a first operating position to permit the contact member to contact the second end portions of the third conducting element and the other one of the first and second conducting elements so as to connect electrically the driven element and the power source and activate the driven element, and a retaining means provided on the button unit and the button retaining passage for retaining releasably the button unit at a second operating position against action of the spring means so as to permit the contact member to be spaced apart from the second end portions of the third conducting element and the other one of the first and second conducting elements to deactivate the driven element.

The sealing member has an edge portion which is positioned on the outer wall surface of the insulated body, and a dome-shaped central portion which covers the button retaining passage of the insulated body to prevent the intrusion of moisture into the switching apparatus via the button retaining passage.

BRIEF DESCRIPTION OF THE DRAWINGS

Other features and advantages of the present invention will become apparent in the following detailed description of a preferred embodiment of this invention, with reference to the accompanying drawings, in which.

DETAILED DESCRIPTION OF THE PREFERRED EMBODIMENT

Figure 1:
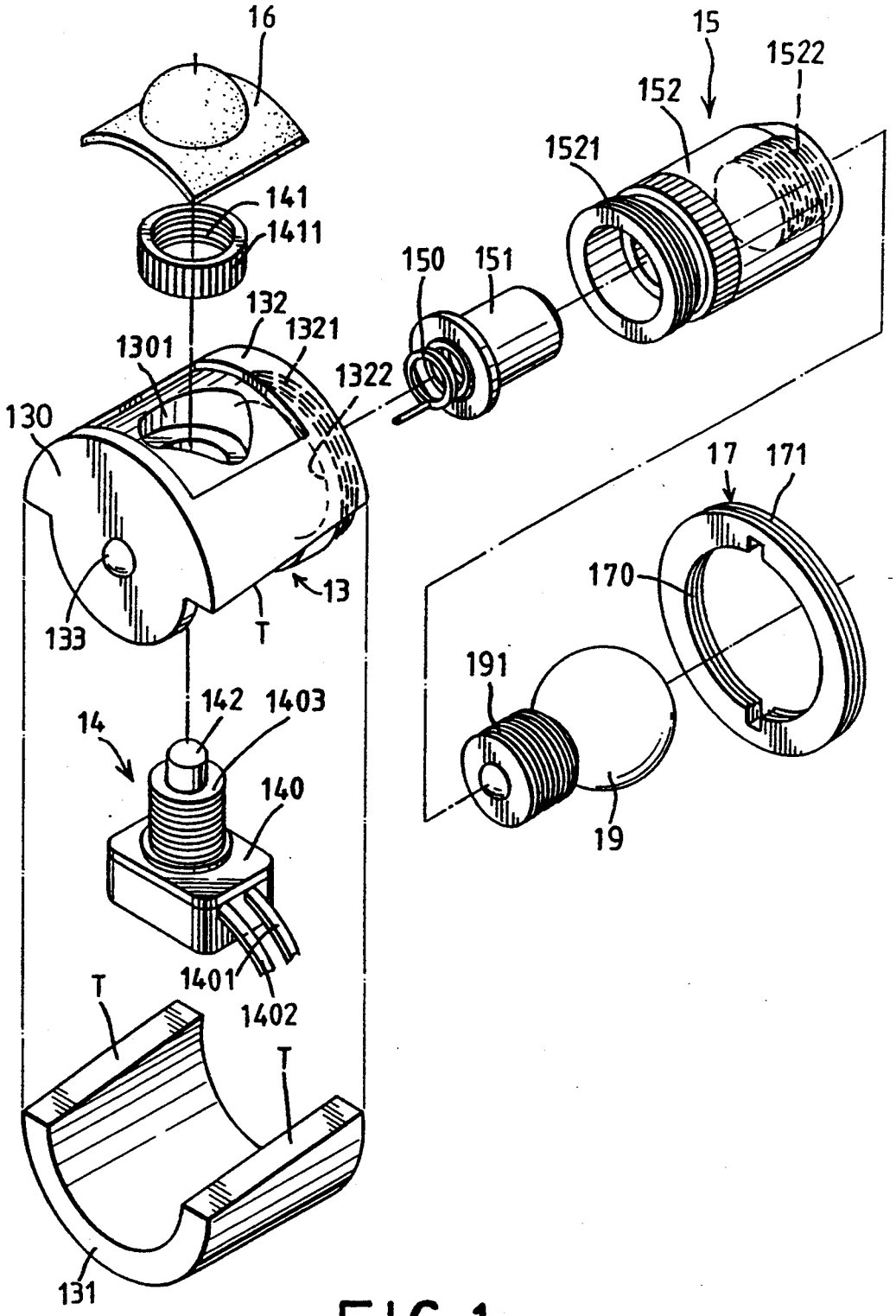
FIG. 1 PRIOR ART
FIG. 1 is an exploded view of a conventional switching apparatus.
Figure 2:
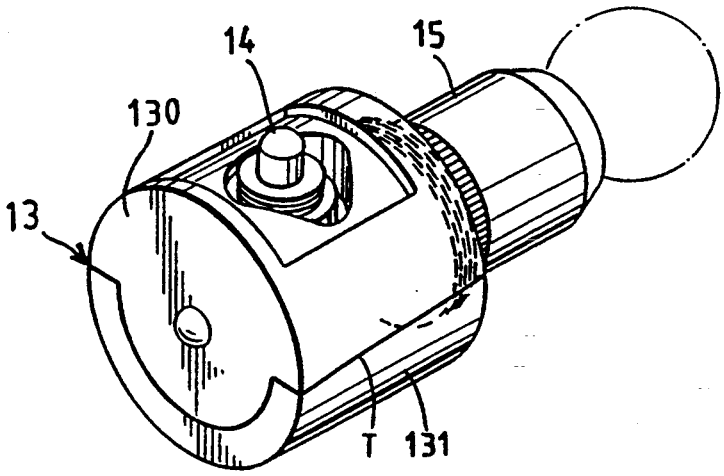
FIG.2 PRIOR ART
FIG. 2 is a perspective view showing the conventional switching apparatus.
Figure 3:
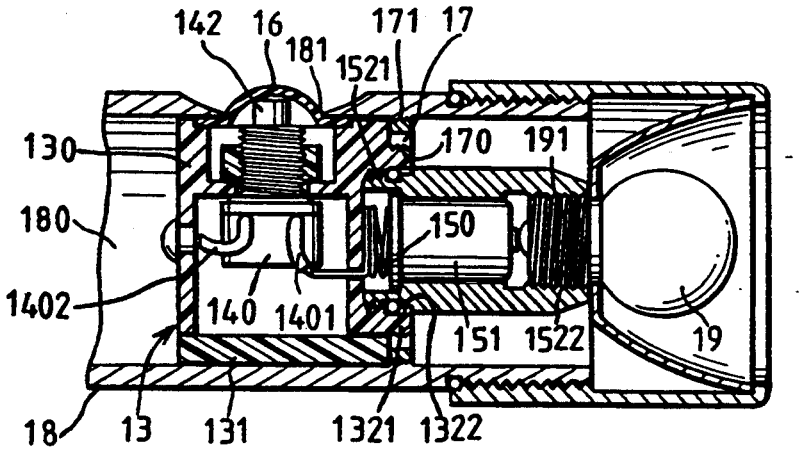
FIG.3 PRIOR ART
FIG. 3 is a schematic sectional view illustrating how the conventional switching apparatus is mounted within an electrical appliance.
Figure 4:
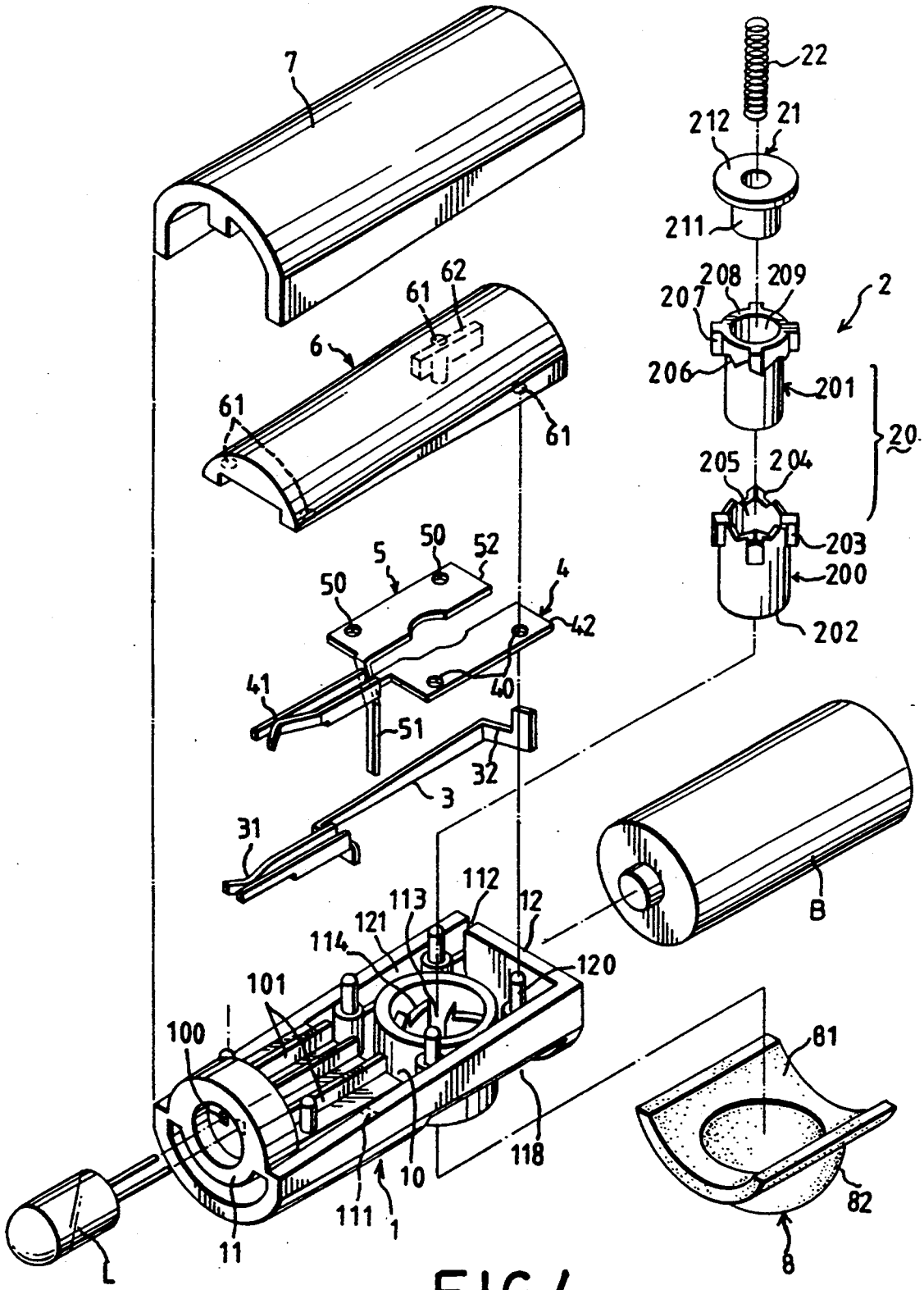
FIG. 4 is an exploded view showing a switching apparatus of the preferred embodiment of this invention.

Referring to FIG. 4, a switching apparatus of the preferred embodiment of this invention is to be installed in an electrical appliance 9 (see FIG. 7) and includes a generally cylindrically shaped hollow insulated body, a conducting unit, a button assembly 2, a longitudinally extending insulated plate 6, and a sealing member 8.

Figure 7:
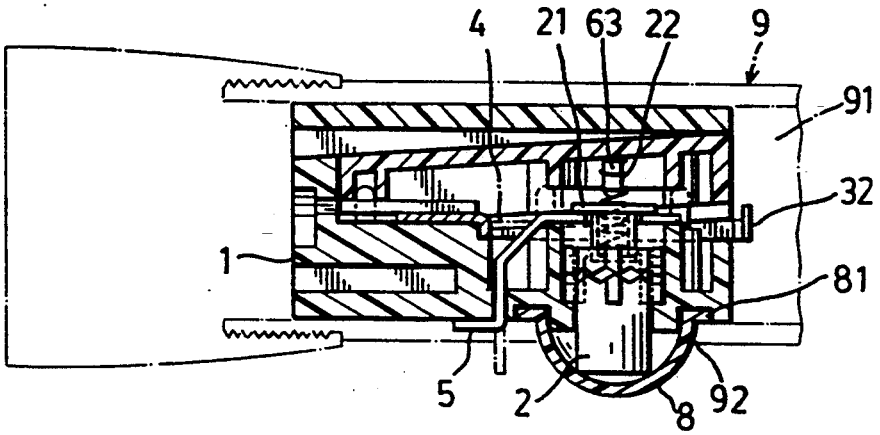
FIG. 7 is schematic sectional view illustrating how the switching apparatus is mounted within an electrical appliance in accordance with this invention.

Referring to FIG. 7, the electrical appliance 9 includes a metal circumferential shell which defines a cavity 91 for containing the switching apparatus that is used to interconnect electrically a driven element and a power source which are also disposed within the cavity 91 of the circumferential shell. The circumferential shell has an opening 92 formed therethrough and communicated with the cavity 91.

Referring again to FIG. 4, in this embodiment, the driven element is a lamp (L) which has two input terminals. The power source is a dry cell (B) which has two output terminals.

Figure 6:
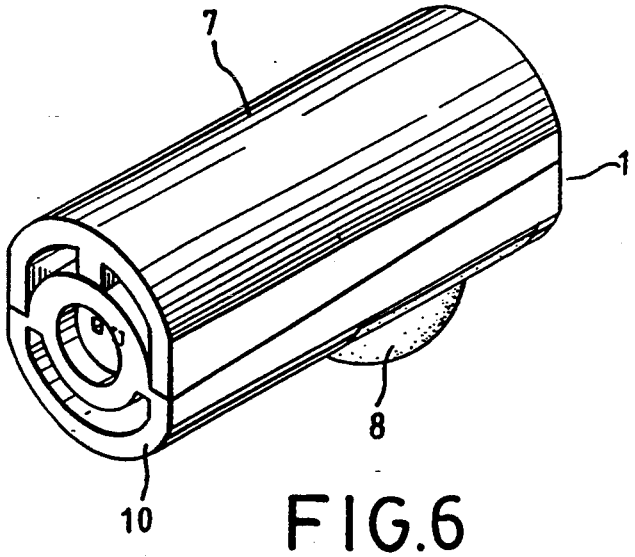
FIG. 6 is a perspective view showing the switching apparatus of this invention.

The insulated body has a first part 1 in the shape of a segmented cylinder and a second part 7 in the shape of a complementary segmented cylinder. The first and second parts 1, 7 have longitudinally extending abutting surfaces. The abutting surfaces of the first and second parts 1, 7 have sloping planes which are inclined relative to an axis of the insulated body. The sloping planes of the abutting surfaces of the first and second parts 1, 7 have a conforming sloping relationship so that the first and second parts 1, 7 of the insulated body sealingly engage each other, as shown in FIG. 6. The circumferential dimension of the outer peripheral wall of the insulated body is adjustable by sliding one of the first and second parts 1, 7 of the insulated body longitudinally with respect to the other one of the first and second parts 1, 7.

Referring again to FIG. 4, the first part 1 confines a longitudinally extending recess 10 and has first and second end walls 11, 12 disposed respectively on two ends of the recess 10. The first end wall 11 is formed with two holes 100 which permit passage of the two input terminals of the lamp (L). The second end wall 12 is formed with a notch 112. The first part 1 of the insulated body is formed with a radial button retaining passage 113 which is positioned between the first and second end walls 11, 12. The button retaining passage 113 is communicated with the recess 10 and is aligned with the opening 92 in the metal circumferential shell of the electrical appliance 9 (see FIG. 7). The first part 1 of the insulated body further has a radial slot 111 formed therethrough. A longitudinal groove 121 is formed in the recess 10 beside the button retaining passage 113. Two axially extending channels 101 are formed in the recess 10 between the first end wall 11 and the button retaining passage 113. Four columns 120 extend into the recess 10 of the first part 1 toward the second part 7. An indented portion 118 is formed in the outer wall surface of the first part 1 around the button retaining passage 113 for receiving the sealing member 8 (see FIG. 7).

The conducting unit is disposed in the recess 10 of the first part 1 of the insulated body and includes elongated first and second conducting elements 3, 4 which have first end portions 31, 41 and second end portions 32, 42. The first end portions 31, 41 of the first and second conducting elements 3, 4 are disposed respectively in the channels 101 of the first part 1 and are connected electrically to the respective one of the input terminals of the lamp (L). The second end portion 32 of the first conducting element 3 extends through the groove 121 and the notch 112 of the first part 1 to lie alongside the outer surface of the second end wall 12 of the first part 1 (see FIG. 7) so as to contact electrically one of the output terminals of the dry cell (B). The second end portion 42 of the second conducting element 4 has two positioning holes 40 formed therethrough.

The conducting unit further includes a third conducting element 5 which has a first end portion 51 and a second end portion 52. The first end portion 51 of the third conducting element 5 extends out of the insulated body via the slot 111 of the first part 1 to contact electrically the inner wall of the metal circumferential shell of the electrical appliance 9 (see FIG. 7) so as to connect electrically with the other one of the output terminals of the dry cell (B) via the metal circumferential shell. The second end portion 52 of the third conducting element 5 is spaced apart from and adjacent to the second end portion 42 of the second conducting element 4 and has two positioning holes 50 formed therethrough. The columns 120 of the first part 1 extend respectively through the positioning holes 40, 50 of the second and third conducting elements 4, 5 so as to position the second end portions 42, 52 of the second and third conducting elements 4, 5 on the first part 1 of the insulated body.

The insulated plate 6 is disposed within the insulated body and overlays closely the recess 10 of the first part 1 of the insulated body. The insulated plate 6 is depressed by the second part 7 of the insulated body so as to position the conducting unit in the recess 10. The insulated plate 6 has four engagement holes 61 which engage respectively the columns 120 of the first part 1 so as to position the insulated plate 6 on the first part 1, and a longitudinally extending protrusion 62 which projects from the insulated plate 6 into the groove 121 to press a portion of the first conducting element 3, thereby preventing the first conducting element 3 from moving upwardly to prevent undesired contact with the second end portion 52 of the third conducting element 5.

Owing to being overlaid closely on the recess 10 of the first part 1, the insulated plate 6 is capable of preventing the intrusion of moisture into the recess 10 of the first part 1 of the insulated body.

The sealing member 8 has an edge portion 81 which is disposed on the indented portion 118 of the first part 1, and a dome-shaped central portion 82 which covers the button retaining passage 113 of the first part 1 of the insulated body and the opening 92 of the metal circumferential shell of the electrical appliance 9 (see FIG. 7).

The first and second parts 1, 7 of the insulated body are disposed longitudinally with respect to each other so that the circumference of the outer peripheral wall of the insulated body is sufficient to enable the outer peripheral wall of the insulated body to engage sealingly the inner wall of the metal circumferential shell of the electrical appliance 9, and to urge the first part 1 of the insulated body into sealing engagement with the edge portion 81 of the sealing member 8, as shown in FIG. 7, thereby compressing the sealing member 8 between the outer wall of the first part 1 of the insulated body and the inner wall of the metal circumferential shell of the electrical appliance 9 so as to effect a tight seal and so as to prevent the intrusion of moisture into the cavity 91 of the metal circumferential shell of the electrical appliance 9.

Referring again to FIG. 4, the button assembly 2 includes a button unit 20 movably disposed in the button retaining passage 113 of the first part 1 of the insulated body, a conducting contact member 21 mounted on one end portion of the button unit 20 and disposed adjacent to the second end portions 42, 52 of the second and third conducting elements 4, 5, a compression spring 22 which constitutes a spring means for biasing the button unit 20 in a radial outward direction to a first operating position (see FIG. 8) to permit the contact member 21 to contact the second end portions 42, 52 of the second and third conducting elements 4, 5 so as to connect electrically the lamp (L) and the dry cell (B) and activate the lamp (L), and a retaining means provided on the button unit 20 and the button retaining passage 113 for retaining releasably the button unit 20 at a second operating position (see FIG. 9) against action of the compression spring 22 so as to permit the contact member 21 to be spaced apart from the second end portions 42, 52 of the second and third conducting elements 4, 5 to deactivate the lamp (L).

Figure 8:
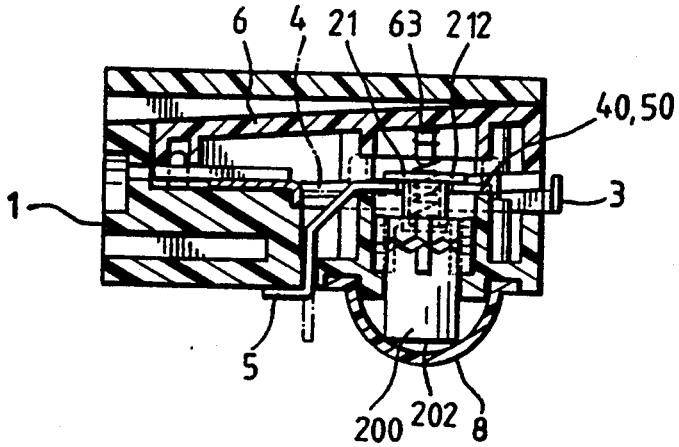
FIG. 8 is a schematic sectional view illustrating the button assembly of the switching apparatus when located at a first operating position in accordance with this invention.
Figure 9:
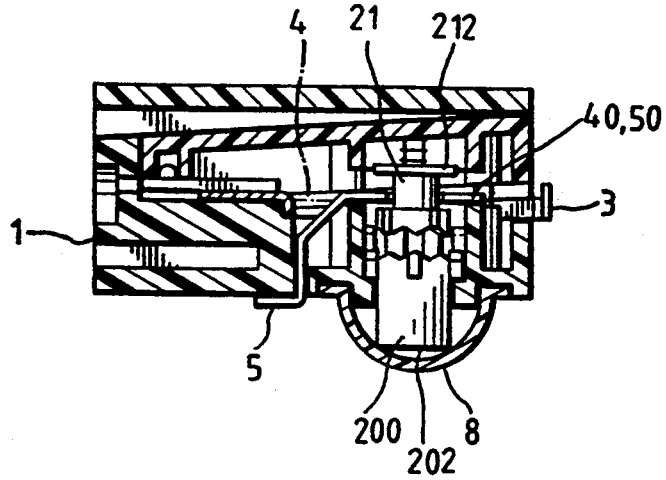
FIG. 9 is a schematic sectional view illustrating how the button assembly of the switching apparatus is moved to a second operating position in accordance with this invention.

Referring to FIGS. 4, 8, 9, the button unit 20 includes a hollow button 200 which has a first end portion provided with a pressing surface 202, and a second end portion formed with several teeth 204 and an accommodating hole 205 surrounded by the teeth 204. The button unit 20 further includes a guiding rod 201 which has a first end portion disposed in the accommodating hole 205 of the button 200 and a second end portion formed with an annular flange 208 and a receiving hole 209 surrounded by the annular flange 208. The annular flange 208 has several teeth 206 which are formed on one end surface thereof and which mesh with the teeth 204 of the button 200, as shown in FIG. 8, so as to position the guiding rod 201 on the button 200 when the button unit 20 is at the first operating position.

The contact member 21 includes a rod portion 211 extending into the button retaining passage 113 of the first part 1 of the insulated body to engage the receiving hole 209 of the guiding rod 201, and a disc portion 212 mounted securely on a distal end of the rod portion 211 and located outside the button retaining passage 113. The disc portion 212 is capable of interconnecting electrically the second end portions 42, 52 of the second and third conducting elements 4, 5 when the button unit 20 is at the first operating position.

The compression spring 22 bears against the disc portion 212 of the contact member 21 at one end portion thereof, and is sleeved on a nose portion 63 (see FIG. 7) of the insulated plate 6 at the other end portion thereof so as to bias the disc portion 212 of the contact member 21 toward the second end portions 42, 52 of the second and third conducting elements 4, 5.

Figure 5:
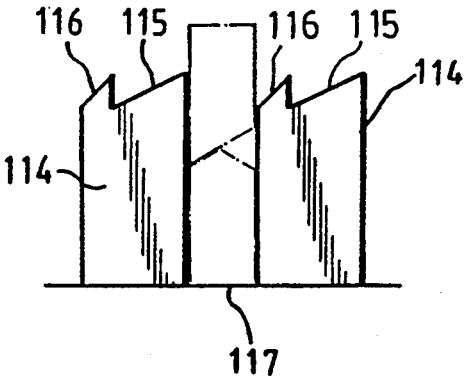
FIG. 5 is schematic view illustrating the operation of a retaining means of a button assembly of the switching apparatus in accordance with this invention.

The retaining means includes four angularly spaced rib sets 114 (only two are shown in FIG. 4) which are formed on the inner wall surface of the button retaining passage 113. Referring to FIG. 5, each two adjacent rib sets 114 cooperatively define a guideway 117 therebetween. Each of the rib sets 114 includes first and second ribs 115, 116 which are arranged side-by-side and which extend in an axial direction of the button retaining passage 113 (see FIG. 4). The first and second ribs 115, 116 have substantially equal lengths and inclined end surfaces which incline in the same direction.

Referring again to FIG. 4, the retaining means further includes four first protrusions 203 which project outwardly and radially from the second end portion of the button 200 and which extend movably in the respective one of the guideways 117 (see FIG. 5), and four second protrusions 207 which project outwardly and radially from the annular flange 208 of the guiding rod 201 and which are aligned respectively with and which abut respectively against the first protrusions 203 of the button 200 when the button unit 20 is at the first operating position.

Referring again to FIGS. 4 and 9, when the pressing surface 202 of the button 200 is depressed to deactivate the lamp (L), the second protrusions 207 of the guiding rod 201 are pushed by the first protrusions 203 to slide along the inclined end surface of the respective one of the first ribs 115 so as to move the button unit 20 to the second operating position, thereby compressing the compression spring 22 and moving the disc portion 212 of the contact member 21 way from the second end portions 42, 52 of the second and third conducting elements 4, 5.

Referring again to FIGS. 4 and 8, when the pressing surface 202 of the button 200 is depressed to activate once more the lamp (L), the second protrusions 207 of the guiding rod 201 slide along the inclined end surface of the respective one of the second ribs 116 and then slide into the respective one of the guideways 117 to abut against the respective one of the first protrusions 203 of the button 200 so as to move the button unit 20 to the first operating position, thereby permitting expansion of the compression spring 22 to move the disc portion 212 of the contact member 21 to interconnect electrically the second end portions 42, 52 of the second and third conducting elements 4, 5.

It is noted that the novel conducting unit and button assembly employed in the switching apparatus of the present invention do not require the use of internal and external screw threads, thereby facilitating assembly of the switching apparatus and simplifying the manufacture of the different components thereof so as to result in a lower manufacturing cost. The objective of the present invention is thus attained.

With this invention thus explained, it is apparent that numerous modifications and variations can be made without departing from the scope and spirit of this invention. It is therefore intended that this invention be limited only as indicated in the appended claims.

I claim:

1. A switching apparatus for an electrical appliance, said switching apparatus being adapted to interconnect electrically two output terminals of a power source and two input terminals of a driven element for controlling operation of said driven element, said switching apparatus comprising:

a generally cylindrically shaped hollow insulated body having a first part in the shape of a segmented cylinder and a second part in the shape of a complementary segmented cylinder, said first and second parts having longitudinally extending abutting surfaces, said first part confining a longitudinally extending recess and having first and second end walls disposed respectively on two ends of said recess, said first end wall being formed with two holes adapted to permit passage of said two input terminals of said driven element therethrough, said second end wall being formed with a notch, said insulated body being formed with a radial button retaining passage which is positioned between said first and second end walls and which is communicated with said recess, said insulated body further having a radial slot;

a conducting unit disposed in said recess of said first part of said insulated body and including elongated first and second conducting elements which have a respective first end portion that is adapted to be connected electrically to a corresponding one of said input terminals of said driven element, and a respective second end portion, said second end portion of one of said first and second conducting elements extending through said notch of said second end wall of said first part of said insulated body and being adapted to be connected to one of said output terminals of said power source, said conducting unit further including a third conducting element which has a first end portion extending out of said insulated body via said slot and being adapted to be connected to the other one of said output terminals of said power source, and a second end portion spaced apart from and adjacent to said second end portion of the other one of said first and second conducting elements; and a button assembly including a button unit movably disposed in said button retaining passage of said first part, a conducting contact member mounted on one end portion of said button unit and disposed adjacent to said second end portions of said third conducting element and the other one of said first and second conducting elements, a spring means for biasing said button unit in a radial outward direction to a first operating position to permit said contact member to contact said second end portions of said third conducting element and the other one of said first and second conducting elements so as to connect electrically said driven element and said power source and activate said driven element, and a retaining means provided on said button unit and said button retaining passage for retaining releasably said button unit at a second operating position against action of said spring means so as to permit said contact member to be spaced apart from said second end portions of said third conducting element and the other one of said first and second conducting elements to deactivate said driven element.

2. A switching apparatus as claimed in claim 1, wherein said abutting surfaces of said first and second parts have sloping planes which are inclined relative to an axis of said insulated body, said sloping planes of said abutting surfaces of said first and second parts of said insulated body having a conforming sloping relationship so that said first and second parts of said insulated body sealingly engage each other.

3. A switching apparatus as claimed in claim 1, wherein said switching apparatus further comprises a longitudinally extending insulated plate which is disposed within said insulated body, said insulated plate overlaying said recess of said first part of said insulated body and being pressed by said second part of said insulated body so as to position said conducting unit in said recess of said first part of said insulated body.

4. A switching apparatus as claimed in claim 1, wherein said switching apparatus further comprises a sealing member which has an edge portion positioned on an outer wall surface of said insulated body, and a dome-shaped central portion covering said button retaining passage of said insulated body.

5. A switching apparatus as claimed in claim 1, wherein said first part further has two axially extending channels which are formed in said recess between said first end wall and said button retaining passage, said channels receiving respectively said first end portions of said first and second conducting elements.

6. A switching apparatus as claimed in claim 1, wherein:

said button unit includes a hollow button which has a first end portion provided with a pressing surface and a second end portion formed with an accommodating hole, and a guiding rod which has a first end portion disposed in said accommodating hole of said button and a second end portion;

said contact member includes a rod portion which extends into said button retaining passage of said insulated body to bear against said second end portion of said guiding rod, and a disc portion mounted securely on a distal end of said rod portion and located outside said button retaining passage, said disc portion being capable of interconnecting electrically said second end portions of said third conducting element and the other one of said first and second conducting elements when said button unit is at said first operating position;

said spring means includes a compression spring which is interposed between said disc portion and said second part so as to bias said disc portion of said contact member toward said second end portions of said third conducting element and the other one of said first and second conducting elements; and said retaining means includes at least two angularly spaced rib sets which are formed on an inner all surface of said button retaining passage, each two adjacent said rib sets cooperatively defining a guideway therebetween, each of said rib sets including first and second ribs which are arranged side-by-side and which extend in an axial direction of said button retaining passage, said first and second ribs having substantially equal lengths and inclined end surfaces which incline in the same direction, said retaining means further including at least two first protrusions which project outwardly and radially from said second end portion of said button and which extend movably in a respective one of said guideways, and at least two second protrusions which project outwardly and radially from said second end portion of said guiding rod and which are respectively aligned with and which abut respectively against said first protrusions of said button when said button unit is at said first operating position;

whereby, when said pressing surface of said button is depressed to deactivate said driven element, said second protrusions of said guiding rod are pushed by said first protrusions to slide along said inclined end surface of a respective one of said first ribs, thereby compressing said compression spring and moving said disc portion of said contact member away from said second end portions of said third conducting element and the other one of said first and second conducting elements, and when said pressing surface of said button is depressed to activate once more said driven element, said second protrusions of said guiding rod slide along said inclined end surface of a respective one of said second ribs and then slide into a respective one of said guideways to abut against a respective one of said first protrusion of said button, thereby permitting expansion of said compression spring to move said disc portion of said contact member to interconnect electrically said second end portions of said third conducting element and the other one of said first and second conducting elements.

7. A switching apparatus as claimed in claim 3, wherein said first part has a plurality of columns extending into said recess toward said second part, said insulated plate having a plurality of engagement holes which engage respectively said columns of said first part.

8. A switching apparatus as claimed in claim 7, wherein said second end portions of said third conducting element and the other one of said first and second conducting elements respectively have a plurality of positioning holes formed therethrough, said columns of said first part extending respectively through said positioning holes so as to position said second end portions of said third conducting element and the other one of said first and second conducting elements on said first part of said insulated body.

* * * * *